United States Patent [19]

Horton et al.

[11] 4,064,083

[45] Dec. 20, 1977

[54] PATTERN MATERIAL COMPOSITION

[75] Inventors: Robert A. Horton, Chesterland; Ella M. Yaichner, Eastlake, both of Ohio

[73] Assignee: Precision Metalsmiths, Inc., Cleveland, Ohio

[21] Appl. No.: 700,175

[22] Filed: June 28, 1976

[51] Int. Cl.[2] ..... C08L 91/00

[52] U.S. Cl. ..... 260/28.5 R; 106/38.7; 106/38.8; 260/32.8 R

[58] Field of Search ..... 106/38.25, 38.24, 38.7, 106/38.8; 260/28.5 R, 32.8 R; 164/35

[56] References Cited

U.S. PATENT DOCUMENTS

| | | | |
|---|---|---|---|
| 3,296,006 | 1/1967 | Horton | 106/38.7 |
| 3,884,708 | 5/1975 | Burkert | 106/38.8 |

*Primary Examiner*—Lorenzo B. Hayes
*Assistant Examiner*—Amelia B. Yarbrough
*Attorney, Agent, or Firm*—Watts, Hoffmann, Fisher & Heinke, Co.

[57] ABSTRACT

For use in making investment molds by the lost pattern process, a pattern material which is machinable and has the capability of being melted out of the molds without cracking them, the material consisting basically of an ethylene-vinyl resin and at least one fatty acid ketone.

7 Claims, 1 Drawing Figure

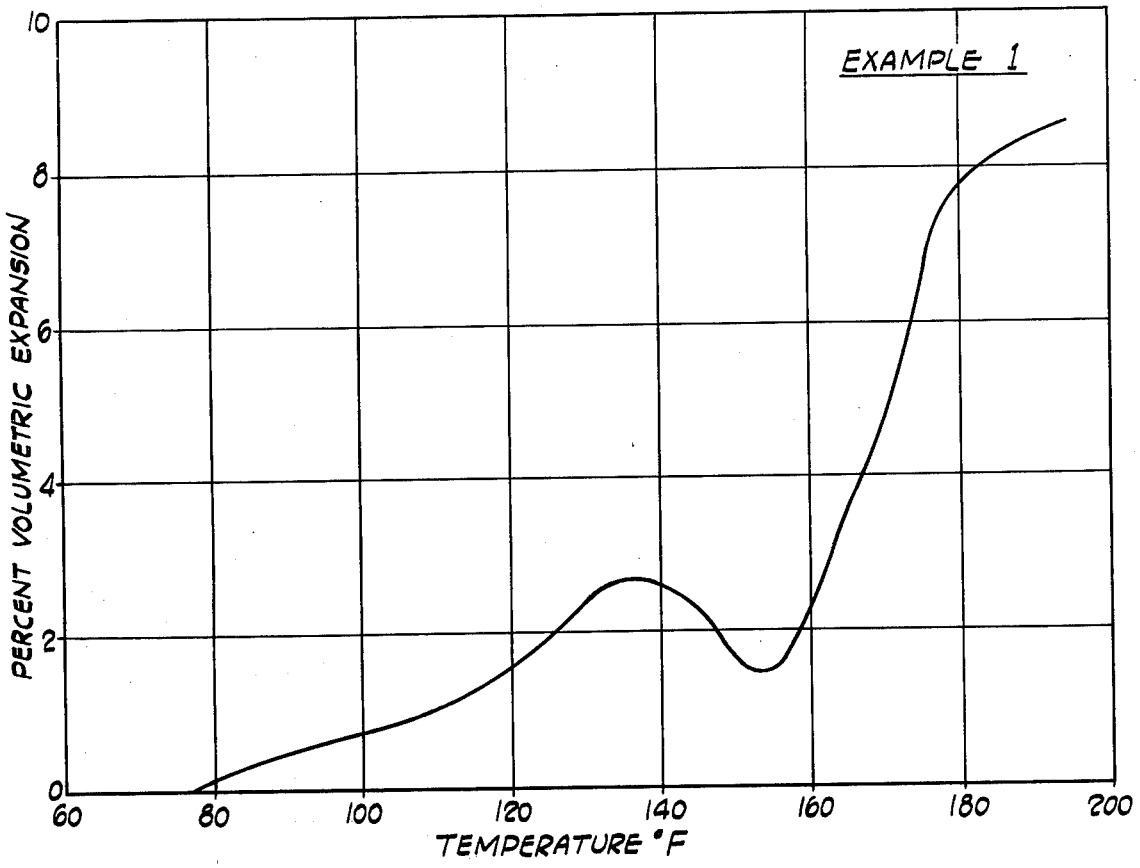
EXAMPLE 1
PERCENT VOLUMETRIC EXPANSION
0
2
4
6
8
10
60
80
100
120
140
160
180
200
TEMPERATURE °F

PATTERN MATERIAL COMPOSITION

BACKGROUND OF THE INVENTION

The present invention relates generally to the investment casting art, and more specifically to a machinable pattern material composition adapted for use in the lost pattern process of precision investment casting.

In the lost pattern process for investment casting, bulk investment molds and ceramic shell molds are made using patterns which are replicas of the parts to be cast in metal. Bulk investment molds are prepared by placing an assembly of the patterns in a flask and filling the flask with a refractory investment slurry which is allowed to harden to form the mold. Ceramic shell molds are prepared by coating a pattern assembly with a refractory slurry, sanding or stuccoing the slurry coating while wet with coarser refractory material, and allowing the coating to harden, as by forced-air drying at room temperature, to form a thin layer of ceramic material having refractory particles embedded in the surface. After the first ceramic layer is sufficiently hard and dry, the steps of coating, draining, stuccoing and drying are repeated until a refractory shell having a desired thickness has been built up around the patterns.

The patterns used in both the bulk investment and the ceramic shell molding processes are made from a disposable material such that the patterns can be melted, as by heating in a furnace, oven, or autoclave, to remove them from the finished mold and provide the casting cavities. The usual pattern materials employed in production work are wax blends and mixtures of waxes and synthetic resins. Patterns made from such materials can be readily and economically molded using production tooling, e.g. wax or plastic injection equipment. The pattern waxes and resin formulations used for production work do not have good machining characteristics.

When only a small number of castings are required, as in prototype work which may involve the production of only one or a few castings for experimental purposes, it is usually faster and more economical to produce the patterns by machining operations instead of using production tooling. Polystyrene has been a conventionally employed material for prototype pattern purposes because it is readily machinable and can be handled without breaking. A significant disadvantage of making patterns from plastics such as polystyrene is that it is difficult to remove the patterns from the molds by heating without cracking the molds. When a mold containing a disposable pattern made of polystyrene is heated to melt or burn out the pattern material, severe internal pressures are created by the thermal expansion of the material. Ceramic shell molds normally do not have sufficient strength to resist these internal pressures caused by the heated pattern material. Even though bulk investment molds are considerably stronger than ceramic shell molds, some cracking of the molds during the pattern removal operation frequently occurs when pastic patterns are used.

An improved prototype pattern material comprising a fatty acid ketone and ethyl cellulose is disclosed in U.S. Pat. No. 3,296,006, issued Jan. 3, 1967. Extensive experience with compositions based on the teaching of this patent has confirmed that its machining properties are excellent and vastly superior to previous materials that have been used for machining prototypes, including polystyrene and other plastics. This experience has also confirmed that the occurrence of mold cracking during the pattern removal operation is markedly less when using pattern compositions based on ethyl cellulose and a fatty acid ketone than when using polystyrene patterns. On the other hand, it has been discovered that the ethyl cellulose-fatty acid ketone composition tends to produce more cracking problems than conventional pattern waxes. This fact has limited the use of the ethyl cellulose-fatty acid ketone material to the production of small patterns when a crack-free pattern removal operation is necessary or to require patching of the cracked molds when larger pattern sizes are attempted. In some instances involving very large patterns, mold cracking can be so severe as to make the use of ethyl cellulose-fatty acid ketone material impractical.

SUMMARY OF THE INVENTION

The present invention provides a new disposable pattern material for investment casting which represents a significant improvement over polystyrene and other prior art materials heretofore used for making prototype patterns. The new pattern material possesses the physical properties required to permit rapid, economical machining of simple or intricate, high quality patterns, and is further characterized by the capability of being melted out of both ceramic and bulk investment molds over a large range of pattern sizes without cracking the molds.

It has been discovered that the combination of properties required of prototype pattern materials, including good machinability and the capability of being melted out of investment molds without cracking them, can be achieved by a composition composed basically of one or more fatty acid ketones and a compatible ethylene-vinyl resin. In accordance with conventional practices, various waxes and resins which are compatible with the basic ethylene-vinyl and fatty acid ketone system, as well as combustible solid fillers, may be included in the composition to modify the basic properties or to reduce the cost.

The pattern material of the invention consists essentially in amounts by weight of from about 0.5 to about 30% ethylene vinyl resin, from 0 to about 30% waxes, solid fillers or resins other than an ethylene-vinyl polymer, and from about 40 to about 99.5% fatty acid ketone. A more preferred range of ingredients consists essentially of from about 5 to about 15% ethylene-vinyl resin, from about 0 to 10% waxes, solid fillers or resins other than ethylene-vinyl, and from 75% to 95% fatty acid ketone.

An especially preferred composition consists of about 45% by weight laurone, about 45% by weight stearone, and about 10% by weight ethylene-vinyl acetate polymer.

Examples of suitable ethylene-vinyl resins include the various ethylene-vinyl acetate copolymers, ethylene-ethyl acrylate copolymers, terpolymers of ethylene-vinyl acetate and organic acid, and the like. Examples of modifying resins that may be used include coumarone-indene, hydrocarbon, and rosin-based resins. Examples of waxes that may be used as modifiers or fillers include paraffin, Fisher-Tropsch, and oxazoline waxes. Examples of suitable ketones are laurone, stearone, behenone, palmitone, and the like. Commercial grades of fatty acid ketones which may not be pure compounds are satisfactory for use.

Patterns made from the new material provided by the invention can be readily machined into a wide range of sizes and configurations. Simple shapes can be made and assembled into more complex ones by means of wax welding or adhesive bonding. The machining of the material does not generate excessive heat so that the machining operation can be carried out rapidly with no softening of the material and with no provision for cooling being required. The properties of the material are such that excellent surfaces and good dimensional stability are obtained. Further, the material is resistant to chipping and cracking under pressure which means that a minimum amount of stock is required to hold the piece in position during the machining operation and that more stock can be removed with each cut. When making set-ups or pattern assemblies, the patterns can be readily attached by wax welding or use of conventional hot melt adhesives to center trees or sprues made of wax, wax-coated paper or cardboard, or wax-coated metal.

An important feature of the new material is that it can be formulated so that, upon heating, the composition initially expands in the manner of conventional materials, but then passes through a temperature range in which the material contracts with increasing temperature. Upon further heating the material resumes normal volumetric expansion. The enhanced capability of the new material so formulated of being melted out of an investment mold without cracking is at least partially attributed to its unique volumetric expansion characteristics. It is believed that the internal mold pressures created by heating during the pattern removal operation are alleviated when the material contracts, and that this permits a surface layer of a pattern made from the material to melt before the bulk of the material can heat up enough to crack the mold.

As described above, an ethylene-vinyl polymer content in the range of from about 5–15% is preferred, but it is contemplated that considerably higher and lower amounts can be used. While strength and hardness properties tend to decrease with decreasing amounts of ethylene-vinyl, useful compositions can be produced containing as little as about 0.5% by weight. Compositions containing no more than about 0.5% ethylene-vinyl resin can be machined satisfactorily without any need for cooling, provided that extra care is taken in clamping and handling because of the reduced strength and hardness. In general, compositions containing small amounts of ethylene-vinyl resin are not recommended for production of delicate or fragile patterns. Further, the cost of compositions containing minimal amounts of ethylene-vinyl resin are more expensive than the preferred compositions because of the increased amount of the ketones that is required.

Amounts of the ethylene-vinyl resin in excess of the preferred upper limit of 15% increase the strength and hardness properties but adversely affect the capability of the material to be melted out of investment molds without cracking them. Since adequate strength and hardness for most patterns is achieved with a ethylene-vinyl resin content of about 15%, there is little advantage of adding larger amounts except for applications where very delicate or fragile patterns are to be machined. Compositions containing about 30% by weight of the resin are limited to making small patterns if a crack-free meltout of the molds is required.

The addition of compatible waxes, resins and combustible solid fillers to the basic vinyl-resin-ketone system tends to detract from the excellent machinability of the new composition of the invention. Nevertheless, a certain amount of such materials can be tolerated if the cost of the composition is an important factor. In some formulations, the addition of a wax such as a paraffin wax may have the additional advantage of improving the compatibility of certain ethylene-vinyl polymers and ketones. The amount of modifying or filler materials should be limited to about 30% by weight and should be kept very low or eliminated entirely when the best machinability is desired.

Materials made in accordance with the invention can be readily melted and poured into blocks, cylinders, and other shapes required for machining particular patterns without the occurrence of shrinkage, voids or other internal defects during solidification. An additional and surprising characteristic of the new material is that it can be formulated to provide compositions which expand during part of their solidification period. It is possible in some cases to produce shapes that are actually larger than the dies or molds in which they are formed.

While the composition of the invention has been described as being especially well suited for use in making machined prototype patterns, it is to be understood that the new material also can be used in production work. The material can be injection molded on standard plastic injection molding machines to produce production patterns. As previously described, patterns made from the new material can be successfully eliminated from both shell and bulk investment molds using the same pattern removal operations conventionally employed with ordinary pattern waxes.

Additional advantages and a fuller understanding of the invention will be had from the following detailed description of the preferred embodiments and the accompanying drawing.

BRIEF DESCRIPTION OF THE DRAWING

The drawing is a graph showing the volumetric expansion curve of a preferred formulation.

DESCRIPTION OF THE PREFERRED EMBODIMENTS

Illustrative compositions of the invention, including the most preferred ones, are shown in the following examples. In each of these examples, the method of blending the ingredients is generally the same. Preferably, the fatty acid ketones are melted together with any waxes included in the composition. Stirring during this first stage may facilitate melting and blending, but is often not required. Modifying resins other than the ethylene-vinyl resin may be added during the initial melting stage. In the event that any difficulty is encountered when attempting to blend in a particular resin, the ketones and waxes (if any) can be melted first and then the modifying resin added and stirred in the mixture.

The ethylene-vinyl resin is added when the other ingredients have been melted and blended. The ethylene-vinyl resins are generally more difficult to incorporate in the mixture and may require the temperature to be raised to about 220° to 250° F. The mixture should be stirred until blending is complete. In the event that solid fillers are to be included in the composition, the fine, solid materials can be added after the ethylene-vinyl resin is stirred into solution.

If the material is to be used for making machined patterns, it can be poured into appropriate molds to produce plates, blocks, cylinders or other shapes required for machining. Preferably, the material should be subjected to a vacuum to remove air bubbles in this operation. If the material is to be used for making injection molded patterns, it can be conditioned to the proper melt temperature and added directly to the reservoir of a conventional pattern injection machine. Alternatively, the material can be poured into trays to form thin slabs or strips which are allowed to cool and then broken into small pieces that can be fed into a hopper of a plastic chopper. Suitable machines for this purpose are commercially available and serve to further reduce the chunks of material to granules of irregular shape which can be fed into the injection cylinder of a conventional plastic injection machine.

EXAMPLE I

An especially preferred composition useful in applications such as prototype work in which disposable patterns are to be machined and then removed from the finished molds by heating consists of the following ingredients in amounts by weight:

45% laurone (ring and ball softening point 161° F)
45% stearone (ring and ball softening point 192° F)
10% ethylene-vinyl acetate copolymer (18% vinyl acetate, ring and ball softening point 390° F)

The foregoing composition exhibits superior machinability so that operations such as drilling, turning and milling can be performed rapidly to produce excellent surface finishes. The material does not tend to soften during machining operations and no cooling of the workpiece is required.

A number of investment casting patterns for small commercial parts were machined from a material of the foregoing composition. Most of the casting patterns were machined as a single piece, although in some cases patterns were assembled from separately machined pieces using a suitable adhesive. The stock material could be clamped for machining without cracking or chipping and could be machined at a rapid rate without cooling.

The composition was also used to make injection molded investment casting patterns. The patterns were injection molded from the molten state using an air-pressurized pot with a heated nozzle. Typical injection conditions were 145°-150° F for the molten pattern material and 50-80 psi. gauge pressure in the pot.

In order to demonstrate the unusual capability of the material of being melted out of ceramic shell molds without cracking them, a number of the patterns were arranged on wax-coated cardboard drums as disclosed, for example, in U.S. Pat. No. 3,520,350. Some of the assembled drums were used to form ceramic shell molds by the usual procedure for dipping, stuccoing and drying, the process being repeated to produce a total of seven coatings of refractory material. The slurry for the first two coatings consisted of colloidal silica as the binder and vehicle, and a mixture of fused silica and zircon as the refractory. The remaining coats were produced using a refractory slurry in which the refractory was a mixture of fused silica and ground fire clay. A fire clay grog was used for stuccoing all of the coatings with a relatively fine particle size grog being used for the first few coatings and progressively coarser particles being used for the remaining coatings. In each instance, the final coating was left unstuccoed.

After the molds had been adequately dried, the cardboard drums were removed and the shells were placed in a steam autoclave operating at a steam pressure of 90-95 psi gauge to melt out the patterns. In all cases, the patterns were melted out of the molds satisfactorily without cracking them.

The molds were then fired to about 2000° F to preheat them for casting. The hot molds were placed over a resin-bonded core, as generally disclosed in U.S. Pat. No. 3,336,970, to form an annular sprue between the inside wall of the mold and the core. A particular vacuum was drawn inside the core and around the mold and the molds were poured with various ferrous alloys, such as 6150 and 8620 steel and type 304 stainless steel. The castings were satisfactory in all respects.

Other patterns machined from the composition of this example were arranged on wax-coated cardboard drums and surrounded by a metal flask which was invested with a gypsum-bonded investment slurry. The slurry was poured into the flasks around the assembled drums under vacuum, using vibration to aid in filling the flasks. The vacuum and vibration were discontinued when the flasks were full. After the molds had set hard, the cardboard drums were removed and the molds were placed in a low pressure steam autoclave operating at 5-7 psi gauge to melt out the patterns. The molds were then fired to 1300° F to burn out any residual pattern material. Castings were poured in the molds from a number of copper base and aluminum base alloys, the molds being first cooled to about 300°-500° F for the latter alloy. All of the castings produced in the molds were satifactory.

In another series of experiments, large cylindrical test patterns were fabricated from the composition of this example. These test patterns measured four inches outer diameter, two inches inner diameter and four inches high. The patterns weighed about 17 ounces. The patterns were mounted on wax-coated cardboard drums and ceramic shell molds were formed around them as previously described. Pattern removal tests were conducted by the following methods: (1) "a flash dewaxing" by placing the mold directly into a furnace at 2000° F, (2) a high-pressure autoclave operating at 90-95 psi gauge, (3) a low-pressure autoclave operating at 5-7 psi gauge, (4) immersing the mold in hot glycerine at 400° F, and (5) placing the mold in a low temperature oven operating at 600° F.

In each of the foregoing tests, the patterns were melted out of the molds successfully without cracking them. An excessive amount of smoke was generated in test (5) so that this procedure is not recommended for general use.

As will be recognized by those skilled in the art, the removal of patterns of the size and shape described above represents a very severe test insofar as mold cracking is concerned. In spite of the massive pattern shape, no cracking was observed in the molds even when using procedures (3) and (5) which are generally recognized as not being satisfactory for removing pattern materials from ceramic shell molds.

It is believed that the ability of the new material to be readily melted out of ceramic shell molds without cracking them is at least partially due to the unique volumetric thermal expansion characteristics of the material. The drawing is a volumetric thermal expansion curve of the composition of this example.

It will be seen that the material initially expands with heat as expected, but then begins to contract with increasing temperature around 136° to 138° F. Contraction of the material continues until around 152° F, after which the material again expands with further increases in temperature. The contraction of the material from about 136° to 152° F is believed to alleviate the internal mold pressures produced by heating of the pattern material so that a surface layer of the material can melt before the bulk of the pattern heats up enough to crack the shell.

EXAMPLE II

A composition was prepared consisting of the following ingredients in amounts by weight:

34% laurone (ring and ball softening point 161° F)
29% stearone (ring and ball softening point 192° F)
22% paraffin wax (ring and ball softening point 158° F)
10% ethylene-vinyl acetate copolymer (28% vinyl acetate, ring and ball softening point 280° F)
5% ethylene-vinyl acetate copolymer (18% vinyl acetate, ring and ball softening point 390° F)

This composition is less expensive than that of Example I due to the lesser amount of laurone and stearone. The material displayed good machinability in the production of casting patterns. The pattern removal characteristics of the composition, although somewhat inferior to those of Example I, were satisfactory over a range of pattern sizes and shapes and were markedly superior to the pattern removal characteristics displayed by either polystyrene or the materials of U.S. Pat. No. 3,296,006.

A number of small commercial parts were produced successfully from shell molds by the procedures described in Example I. The composition of this example was also used to produce cylindrical test patterns as described in Example I. When the large cylindrical test cylinder pattern was melted out of a ceramic shell mold in a steam autoclave operating at 90–95 psi, a tiny hairline crack appeared in the mold. While the crack was very minor and could be repaired, the results indicate that the pattern removal capability of the material of this example is not equal to the composition of Example I.

EXAMPLE III

A composition was prepared consisting of the following ingredients in amounts by weight:

20% laurone
40% stearone
25% Fisher-Tropsch wax (capillary tube melting point 221° F)
15% ethylene-vinyl acetate copolymer (28% vinyl acetate, ring and ball softening point 280° F)

The machinability of the composition was found to be satisfactory. A test cylinder as described in Example I was melted out successfully from a ceramic shell mold without cracking it in an autoclave operated at 90–95 psi gauge.

EXAMPLE IV

A composition was prepared consisting of the following ingredients in amounts by weight:

25% stearone
30% laurone
20% paraffin wax (ring and ball softening point 158° F)
25% ethylene-vinyl acetate copolymer (28% vinyl acetate, ring and ball softening point 280° F)

A number of patterns of commercial parts were machined from the material. The material had excellent machinability, although it demonstrated a slight tendency to soften when cut with a band saw. This tendency was overcome by cutting the material at a slower rate.

The patterns were processed in ceramic shell molds as described in Example I. Most of the patterns were melted out of the molds satisfactorily, but a few molds showed light cracking during the pattern removal operation. Since the cracking was light and easily patched, the castings produced in the molds were satisfactory and had little or no flash.

EXAMPLE V

The following composition is an example of a formulation which expands during part of its solidification period:

53.3% by weight laurone
44.7% by weight stearone
2.0% ethylene-vinyl acetate copolymer (18% vinyl acetate, ring and ball softening point 390° F)

The composition of this example was melted and poured into a silicone rubber mold and allowed to solidify to produce a rectangular block. The block showed cavitation in its top surface indicating the occurrence of volumetric shrinkage during solidification. However, the cross sectional dimensions of the cast block were larger than the mold, and the block could not be inserted back into the mold cavity without distorting the rubber mold. A linear mold cavity dimension of 3.015 inches produced a corresponding linear dimension in the solidified block of 3.045 inches as measured after cooling at room temperature. This represented a linear expansion of about 0.010 inches per inch.

For comparison purposes, a conventional pattern wax was molded in the same manner in the same mold. The solidified pattern wax was noticeably smaller than the mold cavity and easily slipped in and out of the cavity as is characteristic of pattern materials of the prior art.

The following examples set forth additional compositions which illustrate the present invention. As in the case of Examples I–V, the compositions of these additional examples are characterized by the same advantageous machining property and the capability of being melted out of investment molds without cracking them. These properties were demonstrated by fabricating a pattern from each composition and mounting all of the patterns on the same wax-coated drum. A ceramic shell mold was formed around the drum as described in Example I. When the mold was completed, it was placed into a steam autoclave operated at 90–95 psi gauge for the pattern removal operation. All of the patterns were melted out successfully without cracking the mold. The mold was then fired at 1800° F and was cast as described in Example I with a mild steel melt at 2950° F. The castings that were produced were satisfactory.

EXAMPLE VI

40% by weight laurone
33% by weight stearone
22% by weight paraffin wax (ring and ball softening point 158° F)
5% by weight ethylene-ethyl acrylate copolymer (18% ethyl acrylate, ring and ball softening point 307° F)

EXAMPLE XII

34% by weight laurone
29% by weight stearone
22% by weight paraffin wax (ring and ball softening point 158° F)

15% by weight ethylene-vinyl acetate acid terpolymer (ring and ball softening point 304° F, 24–25% vinyl acetate, and an acid number of 4–8 mg. KOH per gram of polymer).

EXAMPLE VIII

34% by weight laurone
29% by weight palmitone (ring and ball softening point 185° F)
22% by weight paraffin wax (ring and ball softening point 158° F)
10% by weight ethylene-vinyl acetate copolymer (28% vinyl acetate, ring and ball softening point 280° F)
5% by weight ethylene-vinyl acetate copolymer (18% vinyl acetate, ring and ball softening point 390° F)

EXAMPLE IX

40% by weight laurone
40% by weight behenone
10% by weight paraffin wax (ring and ball softening point 158° F)
10% by weight ethylene-vinyl acetate copolymer (same as Example I)

In connection with the testing of formulations similar to this example, it was found that compositions which did not include paraffin wax tended to crack when wax-welded. This defect was thought to be due to stresses set up during the solidification of the material. The addition of 10% paraffin wax corrected the condition.

EXAMPLE X

30% by weight behenone
45% by weight myristone (ring and ball softening point 178° F)
15% by weight 2-nonadecone
10% ethylene-vinyl acetate copolymer (same as Example I).

This composition was satisfactory from the standpoints of machinability and melt out. However, it evolved unpleasant fumes in the molten state and is not a preferred composition for this reason.

EXAMPLE XI

30% by weight laurone
15% by weight stearone
45% by weight pelargnone (ring and ball softening point 129° F)
10% by weight ethylene-vinyl acetate copolymer (same as Example I).

Many modifications and variations of the invention will be apparent to those skilled in the art in light of the foregoing disclosure. Therefore, it is to be understood that, within the scope of the appended claims, the invention can be practiced otherwise than as specifically described.

What is claimed:

1. A heat disposable pattern having the characteristics of being machinable and meltable out of investment molds, said material consisting essentially of from 0.5–30% by weight of ethylene-vinyl resin selected from the group consisting of ethylene-vinyl acetate polymers and ethylene-acrylate copolymers from 0 to about 30% by weight of at least one material selected from the class of waxes, solid fillers and resins other than an ethylene-vinyl polymer, and the balance fatty acid ketone.

2. A pattern material as claimed in claim 1 wherein the ethylene-vinyl resin is present in an amount of from about 5 to about 15% by weight.

3. A pattern material as claimed in claim 1 wherein said fatty acid ketone is present in an amount of from about 40–99.5% by weight.

4. A pattern material as claimed in claim 3 wherein said fatty acid ketone is present in an amount of from about 75 to about 95% by weight.

5. A heat disposable pattern material having the characteristics of being machinable and meltable out of investment molds, said material consisting essentially of from about 5 to about 15% by weight ethylene-vinyl resin, selected from the group consisting of ethylene-vinyl acetate polymers and ethylene-acrylate copolymers from about 75 to about 95% by weight fatty acid ketone, and from 0 to about 10% by weight of at least one material selected from the class of compatible resins, waxes and combustible solid fillers.

6. A heat disposable pattern material having the characteristics of being machinable and meltable out of investment molds, said material consisting essentially of about 90% by weight fatty acid ketone and about 10% by weight ethylene-vinyl acetate polymer.

7. A heat disposable pattern material having the characteristics of being machinable and meltable out of investment molds, said material consisting essentially of about 45% by weight stearone, 45% by weight laurone and 10% by weight ethylene-vinyl acetate polymer.

* * * * *

UNITED STATES PATENT AND TRADEMARK OFFICE

CERTIFICATE OF CORRECTION

PATENT NO. : 4,064,083

DATED : December 20, 1977

INVENTOR(S) : Robert A. Horton et al

It is certified that error appears in the above-identified patent and that said Letters Patent are hereby corrected as shown below:

Col. 1, line 34, "readily" should be -- rapidly --

Col. 3, line 57, change "a" to -- an --; line 59, delete "of" substitute -- in --

Col. 8, line 64, change "XII" to -- VII --

Col. 9, EXAMPLE X, line 40, delete "2-nonadecone", substitute -- 2-nonadecanone --

Col. 10, line 12, after "pattern" insert -- material --

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*